US009659724B2

(12) United States Patent
Park et al.

(10) Patent No.: US 9,659,724 B2
(45) Date of Patent: May 23, 2017

(54) KEY APPARATUS FOR ELECTRONIC APPLIANCES

(71) Applicant: Samsung Electronics Co., Ltd., Suwon-si, Gyeonggi-do (KR)

(72) Inventors: Sang-Il Park, Seoul (KR); Sun-Keun Cho, Yongin-si (KR); Min-Jeong Lyu, Seoul (KR); Min-Woo Park, Seoul (KR); Woon-Sung Baek, Goyang-si (KR); Kwang-Yong Lee, Anyang-si (KR); Dong Jeong, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 238 days.

(21) Appl. No.: 14/296,949

(22) Filed: Jun. 5, 2014

(65) Prior Publication Data

US 2014/0374228 A1 Dec. 25, 2014

(30) Foreign Application Priority Data

Jun. 19, 2013 (KR) ..... 10-2013-0070119

(51) Int. Cl.
*H01H 3/08* (2006.01)
*H01H 19/14* (2006.01)
*H01H 19/11* (2006.01)

(52) U.S. Cl.
CPC ..... *H01H 19/14* (2013.01); *H01H 19/11* (2013.01); *H01H 2221/058* (2013.01); *H01H 2231/012* (2013.01); *H01H 2235/018* (2013.01)

(58) Field of Classification Search
CPC ..... H01H 19/02; H01H 2221/058; H01H 2221/08; H01H 19/14; H01H 2019/143; H01H 19/36; H01H 19/56; H01H 19/11
(Continued)

(56) References Cited

U.S. PATENT DOCUMENTS 4,625,084 A * 11/1986 Fowler ..... H01H 19/585 200/11 DA
5,950,035 A * 9/1999 Sakamoto ..... G03B 17/00 116/305

(Continued)

FOREIGN PATENT DOCUMENTS

JP 2000-148370 A 5/2000
JP 2003-287796 A 10/2003
JP 2005-63807 A 3/2005

*Primary Examiner* — Kyung Lee
(74) *Attorney, Agent, or Firm* — Jefferson IP Law, LLP

(57) ABSTRACT

A key apparatus of an electronic device is provided. The key apparatus includes a housing having a cylindrical portion, the cylindrical portion including an upper portion and a lower portion, the upper portion and the lower portion being open, a knob including a circular-plate portion, the circular plate portion having a concavo-convex portion, the concavo-convex portion including a concave portion and a convex portion arranged alternately in a circular shape and an extension portion extended from the circular-plate portion in a downward direction and inserted into a hollow of the cylindrical portion, and the knob moves on the circular-plate portion, an anti-deviation unit configured to prevent the knob from being deviated from the cylindrical portion, an elastic configured to elastically press the concavo-convex portion at a lower side of the circular-plate portion, and a switch connected to the extension portion and switches over movement of the extension portion is delivered.

20 Claims, 13 Drawing Sheets

(58) Field of Classification Search
USPC ..... 200/336, 11 R, 11 TW, 11 DA
See application file for complete search history.

(56) References Cited

U.S. PATENT DOCUMENTS

| | | | | | |
|---|---|---|---|---|---|
| 6,067,424 | A * | 5/2000 | Shono | G03B 17/00 | 200/336 |
| 7,042,510 | B2 * | 5/2006 | Kurahashi | H04N 5/23241 | 348/207.99 |
| 7,592,562 | B1 * | 9/2009 | Vanderwege | H01H 19/14 | 200/336 |
| 8,076,603 | B2 * | 12/2011 | Huang | H01H 3/20 | 200/336 |
| 8,363,159 | B2 * | 1/2013 | Hyodo | G03B 17/00 | 348/373 |
| 2008/0185277 | A1 * | 8/2008 | Saiki | G03B 17/02 | 200/336 |
| 2010/0147665 | A1 * | 6/2010 | Huang | H01H 3/20 | 200/336 |
| 2014/0374228 | A1 * | 12/2014 | Park | H01H 19/11 | 200/336 |

* cited by examiner

KEY APPARATUS FOR ELECTRONIC APPLIANCES

CROSS-REFERENCE TO RELATED APPLICATION(S)

This application claims the benefit under 35 U.S.C. §119 (a) of a Korean patent application filed on Jun. 19, 2013 in the Korean Intellectual Property Office and assigned Serial number 10-2013-0070119, the entire disclosure of which is hereby incorporated by reference.

TECHNICAL FIELD

The present disclosure relates to a rotatable key apparatus for electronic appliances.

BACKGROUND

With the development of electronics communication industries in recent years, an electronic device, such as a cellular phone, an electronics organizer, a Personal Digital Assistant (PDA), a digital camera etc., have become widely used. The electronic device has a plurality of key buttons disposed on a housing. Currently, although a demand on the key button has decreased as a touch screen is used, the electronic device is still equipped with the key buttons for simple and fast manipulations. Although it is intended to install a large touch screen in a limited space with an increase in the use of the touch screen, there are restrictions caused by such key buttons.

Accordingly there is a need for to provide a key apparatus in replacement of a plurality of key buttons to beautify an exterior of an electronic device and to improve usability.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a key apparatus in replacement of a plurality of key buttons to decrease the number of constitutional elements.

Another aspect of the present disclosure is to provide a key apparatus in replacement of a plurality of key buttons to beautify an exterior of an electronic device and to improve usability.

In accordance with an aspect of the present disclosure, a key apparatus of an electronic device is provided. The key apparatus includes a housing having a cylindrical portion, the cylindrical portion including an upper portion and a lower portion, the upper portion and the lower portion being open, a knob including a circular-plate portion, the circular plate portion having a concavo-convex portion, the concavo-convex portion including a concave portion and a convex portion arranged alternately in a circular shape and an extension portion extended from the circular-plate portion in a downward direction and inserted into a hollow of the cylindrical portion, and which the knob moves on the circular-plate portion, an anti-deviation unit configured to prevent the knob from being deviated from the cylindrical portion, an elastic unit configured to elastically press the concavo-convex portion at a lower side of the circular-plate portion, and a switch connected to the extension portion and configured to switch over when at least one movement of the extension portion is delivered.

In accordance with another aspect of the present disclosure, a key apparatus of an electronic appliance is provided. The key apparatus includes a housing having a cylindrical portion, the cylindrical portion including an upper portion and a lower portion, the upper portion and the lower portion being open, and a pair of ball plunger holes an upper portion of the pair of ball plunger holes being open and being disposed to face each other around the cylindrical portion, a knob including a circular-plate portion, the circular-plate portion having a concavo-convex portion including a concave portion and a convex portion alternately arranged in a circular shape and an extension portion extended from the circular-plate portion in a downward direction and inserted to a hollow of the cylindrical portion, the extension portion has a first extension portion including a pair of bolt fixing holes facing each other and a second extension portion disposed inside the first extension portion and including a center shaft and a plurality of satellite shafts arranged around the center shaft, and a pair of compression springs contained in the pair of ball plunger holes, a pair of balls elastically supported from the pair of compression springs and elastically pressing the concavo-convex portion of the circular-plate portion, a fixing plate disposed in a hollow of the cylindrical portion, the fixing plate having a pair of bolt fixing holes bolt-jointed with the pair of bolt fixing holes of the first extension portion, and having a shaft through-hole through which the second extension portion passes, and a switch placed on a Printer Circuit Board (PCB), the switch connected to the second extension portion, and switched over when one of a rotation and a linear movement of the second extension portion is delivered, wherein the knob rotates about the extension portion, and in case of passing one of the concave portion or the convex portion, the pair of balls moves one of upward and downward on the pair of ball plunger holes, and wherein the knob selectively moves linearly in a facing direction of the pair of ball plunger holes, and the pair of balls are in contact with a linear groove formed on the concave portion in a sliding manner.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

According to various embodiments of the present disclosure, a key apparatus is provided in replacement of a plurality of key buttons to decrease the number of constitutional elements. According to various embodiments of the present disclosure, a key apparatus is provided in replacement of a plurality of key buttons to ensure a space for placing a large screen of an electronic device. According to various embodiments of the present disclosure, a key apparatus is provided in replacement of a plurality of key buttons to beatify an exterior of an electronic device and to improve usability. According to various embodiments of the present disclosure, it is possible to improve a manipulation sense of a switch (e.g., a rotary switch) which is switched over according to various motions (e.g., a rotation or linear movement).

Figure 1:
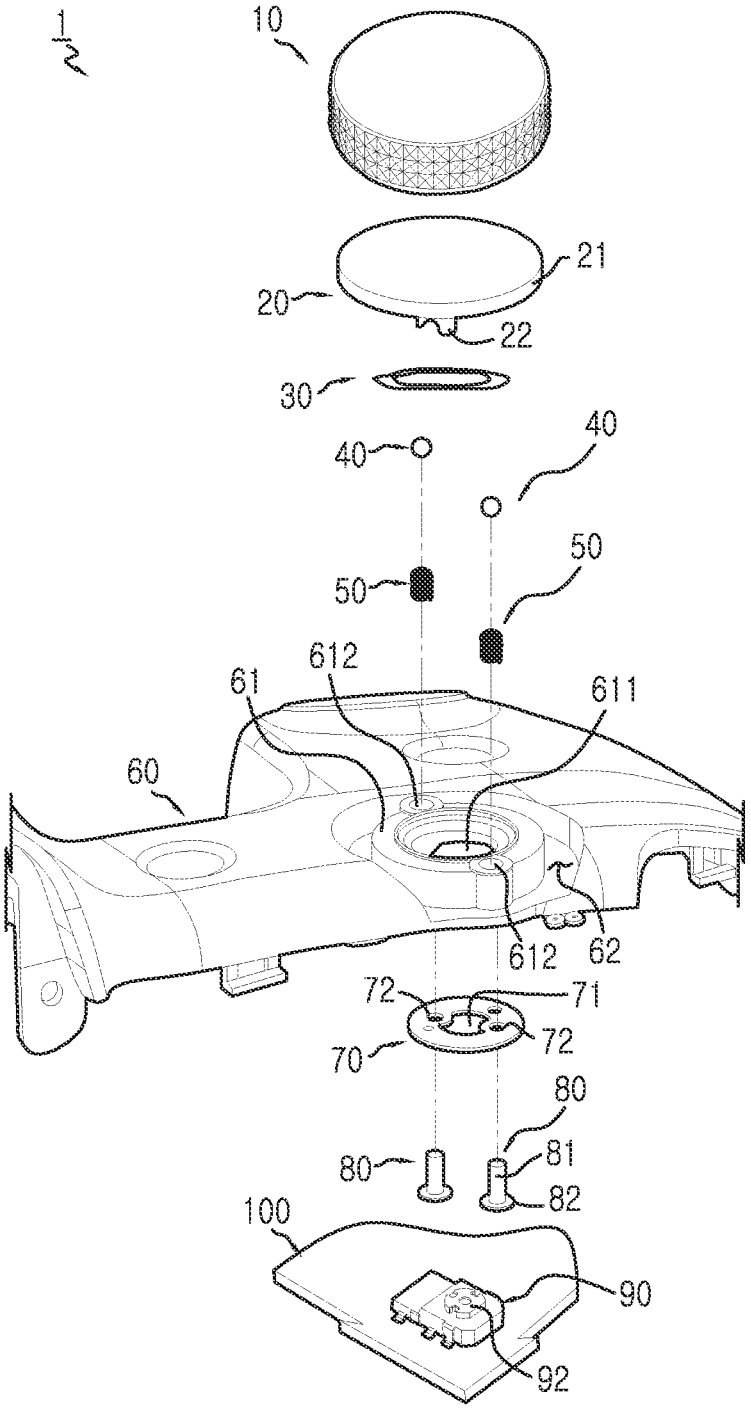
FIG. 1 is an exploded perspective view of a key apparatus of an electronic device according to various embodiments of the present disclosure.

FIG. 1 is an exploded perspective view of a key apparatus of an electronic device according to various embodiments of the present disclosure.

Referring to FIG. 1, a key apparatus 1 includes a cap 10, a knob 20, a plate spring 30, a pair of balls 40, a pair of compression springs 50, a housing (or case frame) 60, a fixing plate 70, a pair of bolts 80, a switch unit 90, and a Printed Circuit Board (PCB) 100. A circular-plate portion 21 of the knob 20 may be inserted inside the cap 10. The cap 10 which fixes the knob 20 may be placed against a cylindrical portion 61 of the housing 60. The knob 20 may include an extension portion 22 vertically extended from the circular-plate portion 21. The extension portion 22 may be inserted to a hollow 611 of the cylindrical portion 61 of the housing 60. The fixing plate 70 may be disposed below the cylindrical portion 61 of the housing 60, and may be bolt-jointed with the extension portion 22 of the knob 20. The pair of bolts 80 may have a neck 81 pass through a pair of bolt through-holes 72 stopped by a head 82, and may be bolt-jointed with a pair of bolt fixing grooves (not shown) provided in the extension portion 22 of the knob 20. Since the fixing plate 70 has a wider width than the opening 611 of the housing 60, the knob 20 cannot be deviated upward. A plurality of shafts of the extension portion 22 of the knob 20 may pass through a shaft through-hole 71 of the fixing plate 70, and may be inserted to fit a groove provided in a mover 92 of the switch unit 90. The housing 60 may include a pair of ball plunger holes 612 facing each other about the cylindrical portion 61. The pair of compression springs 50 may be contained in the pair of ball plunger holes 612. The pair of balls 40 may be disposed between the pair of compression springs 50 and the circular-plate portion 21 of the knob 20. The pair of balls 40 may be elastically supported by the pair of compression springs 50, and may elastically press a lower portion of the circular-plate portion 21. A concavo-convex portion (not shown) in which a concave portion and a convex portion are alternatively arranged may be formed to the lower portion of the circular-plate portion 21. Since the pair of balls 40 is elastically in contact with the concavo-convex portion of the knob 20, it is possible to have a manipulation sense capable of rotating the cap by a specific angle. The plate spring 30 may be disposed between the circular-plate portion 21 of the knob 20 and the cylindrical portion 61 of the housing 60, and may elastically press the knob 20 in an upward direction. If the cap 10 rotates, the extension portion 22 of the knob 20 allows the mover 92 of the switching unit 90 to rotate, and a rotary switch (not shown) of the switch unit 90 connected to the mover 92 may be switched over. If the cap 10 linearly moves, the pair of balls 40 may be in contact with a linear groove of a concave portion (not shown) in a sliding manner, and the extension portion 22 of the knob 20 allows the mover 92 to linearly move. A shaft (not shown) to which a force from the mover 92 is delivered may press a dome switch (not shown).

Figure 2:
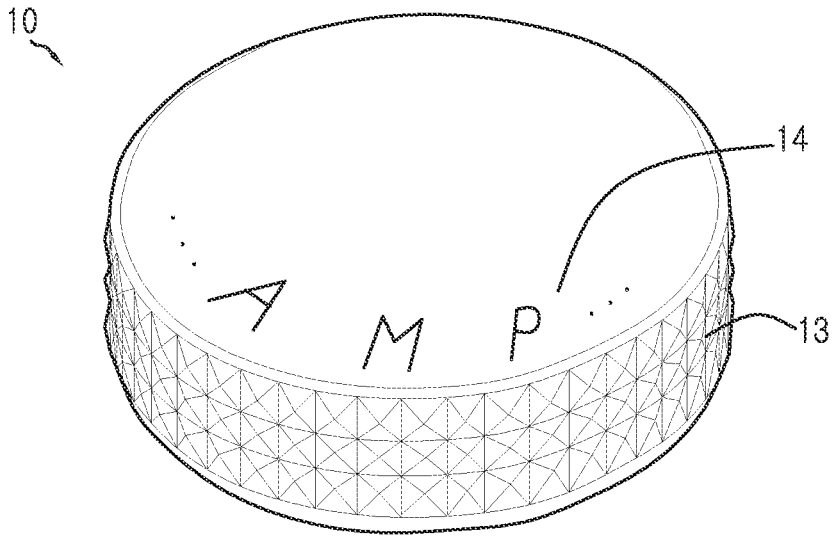
FIG. 2 is a perspective view of a cap of a key apparatus according to various embodiments of the present disclosure.
Figure 2:
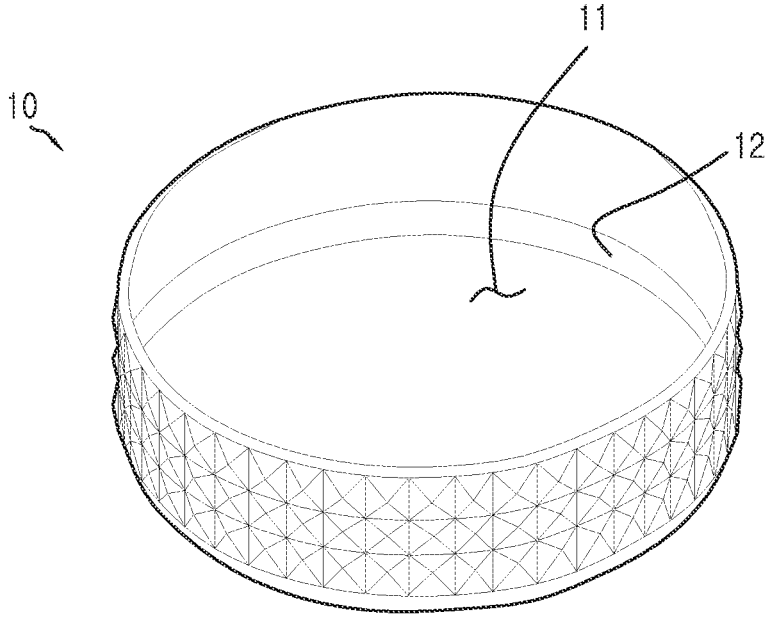

FIG. 2 is a perspective view of a cap of a key apparatus according to various embodiments of the present disclosure.

Referring to FIG. 2, the cap 10 may have a shape of a circular container including a containing portion 11 which is open in a downward direction. A groove 12 having a circular circumference may be formed to an inner side of the containing portion 11, so as to be joined with the knob 20. Characters 14 indicating functions corresponding to rotation angles may be printed on an upper outer surface of the cap 10. Protrusions 13 regularly arranged may be formed on a lateral outer surface of the cap 10.

Figure 3:
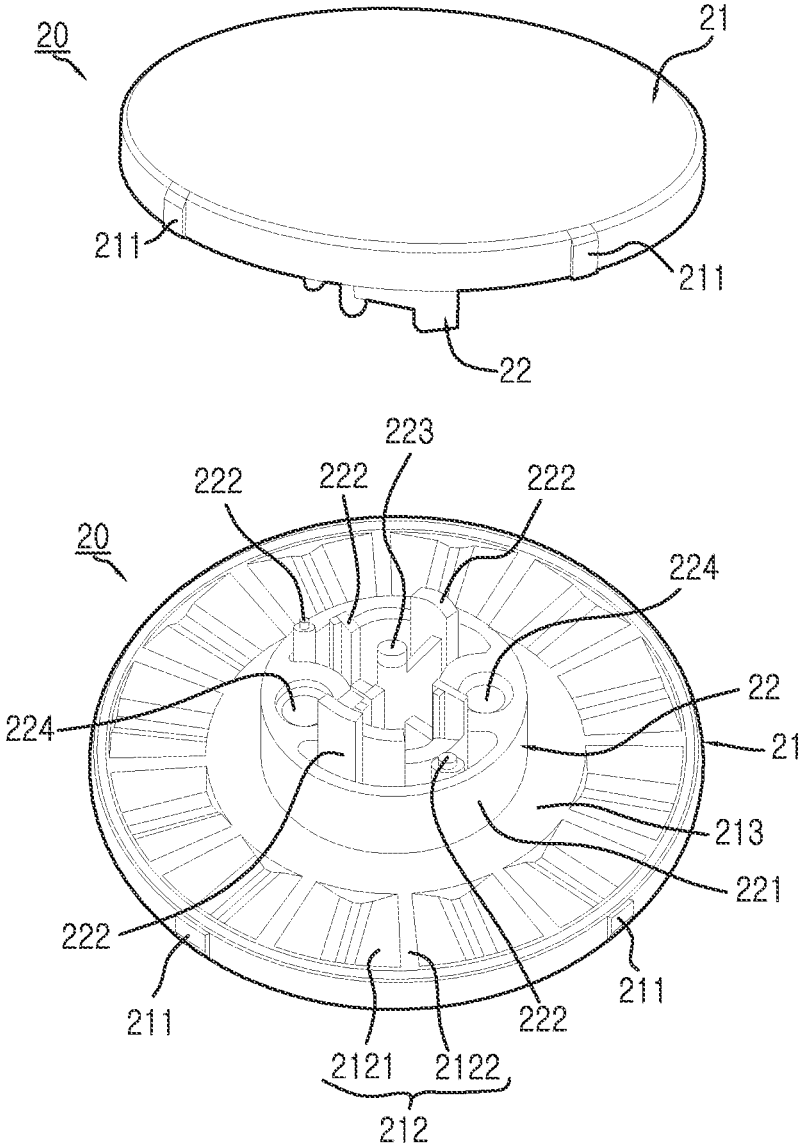
FIG. 3 is a perspective view of a knob according to various embodiments of the present disclosure.

FIG. 3 is a perspective view of a knob according to various embodiments of the present disclosure.

Referring to FIG. 3, the knob 20 may include the circular-plate portion 21 and the extension portion 22 extended downward from the circular-plate portion 21. Clamping protrusions 211 which protrude by a specific height may be formed on a lateral portion of the circular-plate portion 21. The circular-plate portion 21 may be inserted to the containing portion 11 of the cap 10, and the fixing protrusions 211 of the circular-plate portion 21 may be inserted to fit the groove 12 of the cap 10. The extension portion 22 may include a cylindrical portion 221 (i.e., a first extension portion) extended from the circular-plate portion 21, as well as a plurality of shafts (i.e., a second extension portion) disposed inside the cylindrical portion 221 and extended from the circular-plate portion 21. A pair of bolt fixing holes 224 facing each other may be formed to the cylindrical portion 221. The pair of bolt fixing holes 224 may be formed to an inner side of the cylindrical portion 221. The plurality of shafts may include a center shaft 223 and a plurality of satellite shafts 222 disposed around the center shaft 223. The extension portion 22 may be inserted to the hollow 611 of the housing 60, and may move on the hollow 611 (e.g., a rotation or linear movement, etc.). The plurality of shafts 222 and 223 may be formed to be longer than a cylindrical portion 221, and may be inserted to fit grooves 921 of the mover 92 of the switch unit 90 (See FIG. 7). The circular-plate portion 21 may include a ring-shaped flat circular contact surface 213 formed on a circumferential surface of the cylindrical portion 221. The circular contact surface 213 may be in contact with elastic pieces 32 of the plate spring 30 (See FIG. 4). The circular-plate portion 21 may include a concavo-convex portion 212 disposed to an outer side than the circular contact surface 213. The concavo-convex portion 212 may include a concave portion 2121 and a convex portion 2122. The concave portion 2121 and the convex portion 2122 may be alternately arranged in a circular shape. The pair of the concave portion 2121 and the convex portion 2122 may be arranged in an even-number pair (e.g., 12 pairs). The concave portion 2121 and the convex portion 2122 may be configured by considering the number of switchovers according to a rotation angle of a rotary switch 96 of the switch unit 90. The concave portion 2121 may be a groove which is formed in a long linear shape in an outward direction from the rotation axes 222 and 223. The concave portion 2121 may be disposed to face the rotation axes 222 and 223. If the knob 20 linearly moves, a linear groove of the concave portion 2121 of the knob 20 and the pair of balls 40 may be in contact in a sliding manner. A connection portion between the concave portion 2121 and the convex portion 2122 may have a smooth shape. If a user allows the cap 10 to rotate and then takes off a hand after locating the pair of balls 40 to the convex portion 2122 or to the connection portion between the concave portion 2121 and the convex portion 2122, since the pair of balls 40 elastically presses the concavo-convex portion 212 of the knob 20, the knob 20 is rotated by a cam movement, and the pair of balls 40 may be located to the concave portion 2121. The knob 20 and the cap 10 may be formed in an integral manner.

Figure 4:
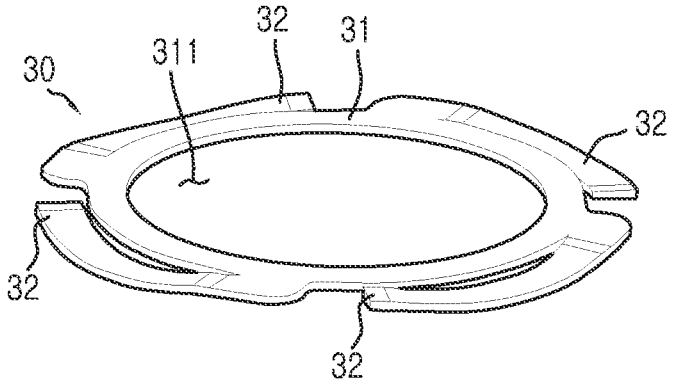
FIG. 4 is a perspective view of a plate spring according to various embodiments of the present disclosure.

FIG. 4 is a perspective view of a plate spring according to various embodiments of the present disclosure.

Referring to FIG. 4, the plate spring 30 may include a circular ring piece 31 and a plurality of elastic pieces 32. The circular ring piece 31 may include a hollow 311 in a center portion. The cylindrical portion 221 of the knob 20 may pass through the hollow 311 of the circular ring piece 31. The plurality of elastic pieces 32 may be extended obliquely in a circular direction and an upward direction from a lateral portion of the circular ring piece 31. One end of the plurality of elastic pieces 32 may be supported by the circular ring piece 31, and thus elastic deflection may be possible. The plate spring 30 may be disposed between the circular-plate portion 21 of the knob 20 and the housing 60. The circular ring piece 31 of the plate spring 30 may be disposed above a circular-shape ring protrusion 613 formed on the cylindrical portion 61 of the housing 60. (See FIG. 5). The elastic pieces 32 of the plate spring 30 may elastically press the circular contact surface 213 of the circular-plate portion 21. The plate spring 30 may prevent the knob 20 from being slanted in any direction by the pair of balls 40 facing each other.

Figure 5:
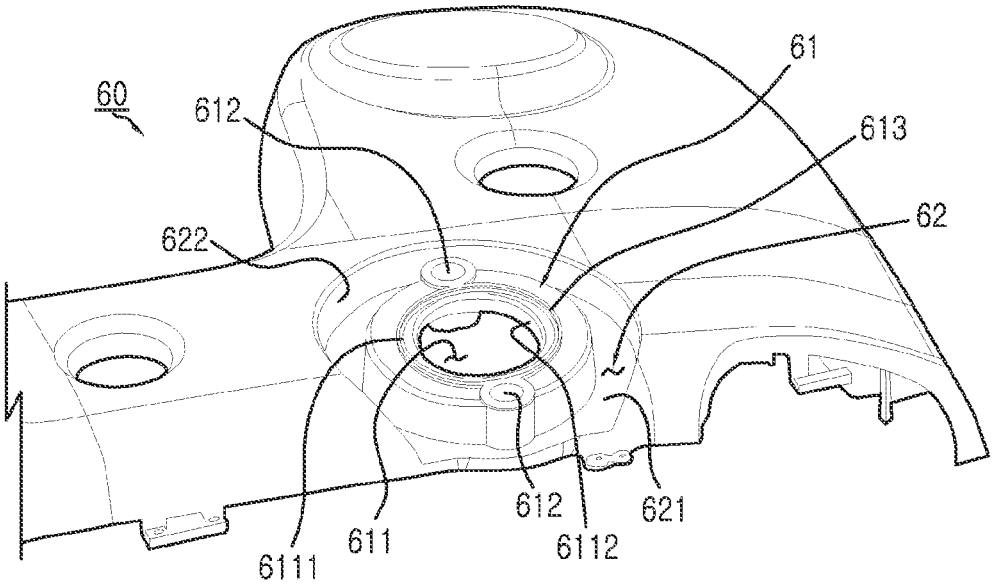
FIG. 5 is a perspective view of a housing according to various embodiments of the present disclosure.

FIG. 5 is a perspective view of a housing according to various embodiments of the present disclosure.

Referring to FIG. 5, the housing 60 may include the cylindrical portion 61 and a groove 62. The cylindrical portion 61 may have an upwardly tapered cylindrical shape. The cylindrical portion 61 may include the hollow 611, which passes through between an upper portion and a lower portion, in a center portion. The hollow 611 may include an upper hollow 6111 and a lower hollow 6112 disposed below the upper hollow 6111. The upper hollow 6111 may be connected with the lower hollow 6112, and may include a narrower width than the lower hollow 6112. The groove 62 may be formed on a circumferential portion of the cylindrical portion 61. The groove 62 may have a shape which is open in an upward direction. The groove 62 may have a shape open in a frontward direction (e.g., a screen direction) of an electronic device. A lateral wall of the cap 10 may be inserted into the groove 62 of the housing 60. A bottom 621 of the groove 62 may be flat. A lateral wall 622 of the groove 62, facing a lateral wall of the cylindrical portion 61, may be vertical to the bottom 621. The cylindrical portion 61 may include the pair of ball plunger holes 612. The pair of compression springs 50 may be contained in the pair of ball plunger holes 612. The pair of ball plunger holes 612 may face each other about the hollow 611, and may be open in an upward direction. The pair of balls 40 may be disposed above the pair of compression springs 50 contained in the pair of plunger holes 612. If there is no change in the shape of the pair of compression springs 50, a portion (e.g., ⅓ of a volume) of the pair of balls 40 may be basically contained in the pair of plunger holes 612. A facing direction of the pair of ball plunger holes 612 may be orthogonal to a screen of the electronic device. The extension portion 22 of the knob 20 may be inserted to the hollow 611 of the cylindrical portion 61 of the housing 60. The hollow 611 of the cylindrical portion 61 may have a relatively long shape in a facing direction of the pair of ball plunger holes 612. The extension portion 22 of the knob 20 may linearly move horizontally along the hollow 611 of the cylindrical portion 61. A circular-shape ring protrusion 613 may be formed on the cylindrical portion 61 of the housing 60.

Figure 6:
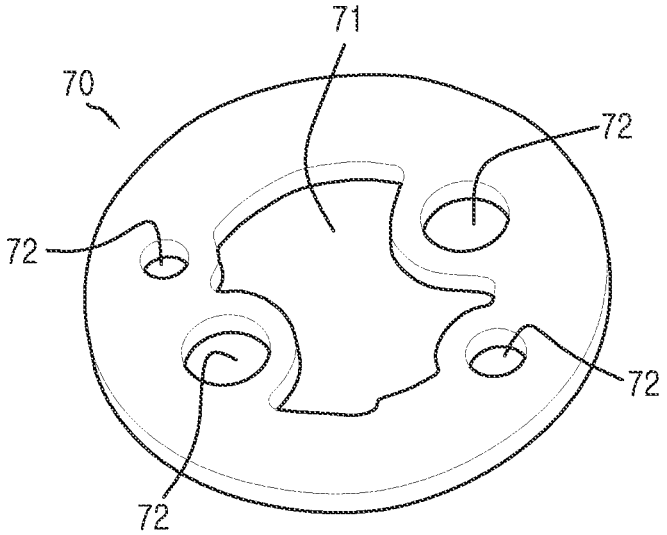
FIG. 6 is a perspective view of a fixing plate according to various embodiments of the present disclosure.

FIG. 6 is a perspective view of a fixing plate according to various embodiments of the present disclosure.

Referring to FIG. 6, the fixing plate 70 may have a circular-plate shape. The fixing plate 70 may be disposed to the lower hollow 6112 of the cylindrical portion 61 of the housing 60. The cylindrical portion 61 is caught by the upper hollow 6111 of the cylindrical portion 61 of the housing 60, and thus cannot be deviated in an upward direction. The cylindrical portion 61 may include a shaft through-hole 71 through which the center shaft 223 and the plurality of satellite shafts 222 of the extension portion 22 may pass. The fixing plate 70 may include a pair of bolt through-holes 72 through which a neck 81 of the pair of bolts 80 may pass. The neck 81 of the pair of pair of bolts 80 may be bolt-jointed with the pair of bolt fixing holes 224 provided in the cylindrical portion 221 of the knob 20 after passing through the pair of bolt through-holes 72 of the fixing plate 70. The fixing plate 70 cannot be deviated in a downward direction due to a head 82 of the pair of bolts 80, and cannot be deviated in an upward direction due to the upper hollow 6111 of the cylindrical portion 61 of the housing 60. The knob 20 cannot be deviated in an upward direction due to the fixing plate 70 and the pair of bolts 80. The plate spring 30 may be disposed between a lower portion of the circular-plate portion 21 of the knob 20 and an upper portion of the circular-plate portion 21 of the housing 60.

Figure 7:
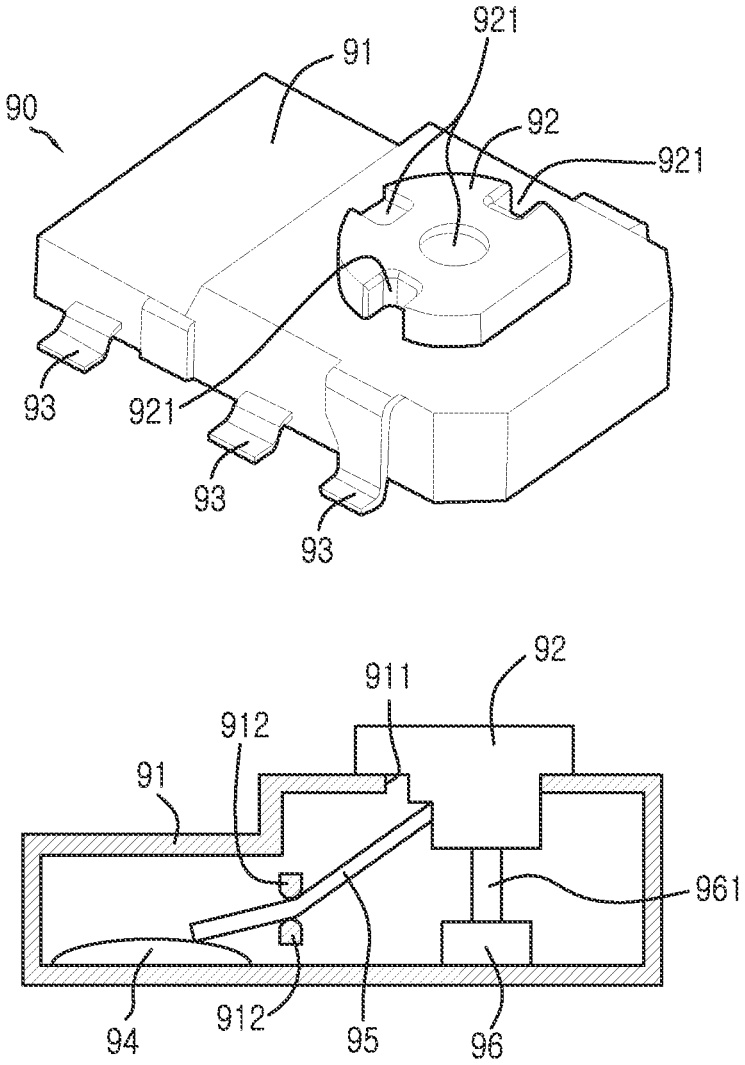
FIG. 7 is a perspective view and a partial cross-sectional view of a switch unit according to various embodiments of the present disclosure.

FIG. 7 is a perspective view and a partial cross-sectional view of a switch unit according to various embodiments of the present disclosure.

Referring to FIG. 7, the switch unit 90 may include a body 91, the mover 92, a plurality of tabs 93, a dome switch 94, a shaft 95, and the rotary switch 96. An opening 911 may be formed to an upper portion of the body 91. The mover 92 may rotate or linearly move on the opening 911 of the body 91. The grooves 921 that may be joined with the center shaft 223 and the plurality of satellite shafts 222 of the extension portion 22 of the knob 20 may be formed to an upper portion of the mover 92. The dome switch 94 and the rotary switch 96 may be disposed to an inner bottom portion of the body 91. The dome switch 94 may use a mechanism in which two transmission paths are electrically connected through a dome when an upper dome-shaped film is pressed and thus the switch is in contact with a contact point located to a lower portion. The rotary switch 96 may use a mechanism in which the switch is switched over when an electrical contact point changes in its position according to a rotation angle. An extension portion 961 of the rotary switch 96 is connected with the mover 92. The rotary switch 96 may be switched over when the mover 92 rotates. The shaft 95 may have a shape in which a proper position is bent. The body 91 may include supporters 912 capable of supporting a bent portion of the shaft 95 at each of upper and lower portions. One end of the shaft 95 may be in contact with one side of the mover 92, and the other end of the shaft 95 may be in contact with the dome switch 94. The extension portion 961 of the rotary switch 96 may have an elasticity with respect to a linear movement of the mover 92. If the mover 92 moves linearly, the shaft 95 may intend to rotate about the supporters 912, and thus the dome switch 94 may be pressed. The switch unit 90 may be placed to the PCB 100. The plurality of tabs 93 may protrude from the body 91, and may be used to be mounted on a surface of the PCB 100.

The PCB 100 may be a circuit board on which a basic circuit and a plurality of electronic components are placed. The PCB 100 may be able to set an execution environment of the electronic device, to maintain information thereof, to reliably drive the electronic device, and to smoothly exchange a data input and output of all apparatuses of the electronic device. The PCB 100 may be fixed to the housing 60.

Figure 8:
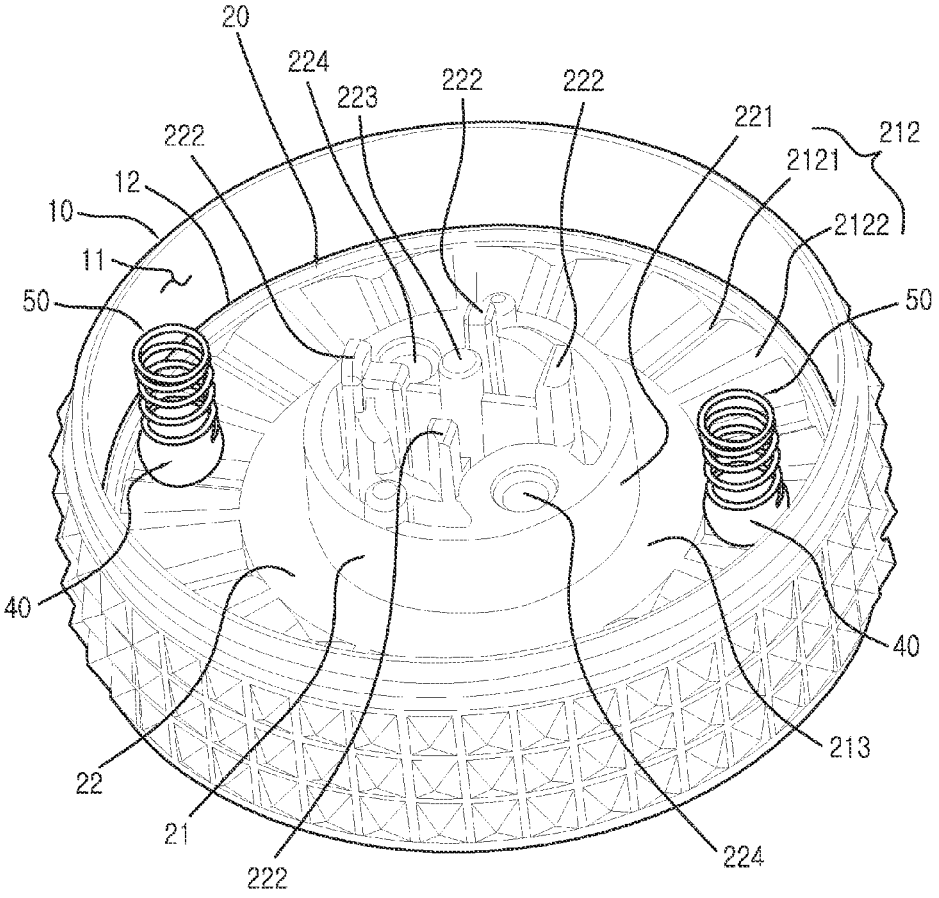
FIG. 8 is a perspective view illustrating a combined state of a cap and a knob according to various embodiments of the present disclosure.

FIG. 8 is a perspective view illustrating a combined state of a cap and a knob according to various embodiments of the present disclosure.

Referring to FIG. 8, the knob 20 may be inserted to fit the groove 12 formed to an inner side of the containing portion 11 of the cap 10, and may move together with the cap 10. The knob 20 may include the circular-plate portion 21 and the extension portion 22 extended vertically from the circular-plate portion 21. The circular-plate portion 21 may include the flat circular contact portion 213 disposed on a circumferential surface of the ring-shaped cylindrical portion 221. The circular contact surface 213 may be in contact with the elastic pieces 33 of the plate spring 30. (See FIG. 4) The circular-plate portion 21 may include the concavo-convex portion 212 disposed to an outer side than the circular contact surface 213. The concavo-convex portion 212 may be a concavo-convex portion in which the concave portion 2121 and the convex portion 2122 are alternatively arranged in a circular manner about the cylindrical portion 221. The concave portion 2121 may be a groove linearly formed in an outward direction from the center shaft 223. The concave portion 2121 may face the center shaft 223 of the knob 20. The pair of balls 40 may be elastically supported from the pair of compression springs 50, and may elastically press the concavo-convex portion 212 of the knob 20. The pair of balls 40 may be in contact with the concave portion 2121 in a sliding manner. The cap 10 which fixes the knob 20 may linearly move in a facing direction of the pair of balls 40. An inner portion of the cylindrical portion 221 may include the center shaft 223 and the plurality of satellite shafts 222 extended from the circular-plate portion 21. The plurality of satellite shafts 222 may be disposed around the center shaft 223. A pair of bolt fixing holes 224 facing each other may be formed to the cylindrical portion 221.

Figure 9:
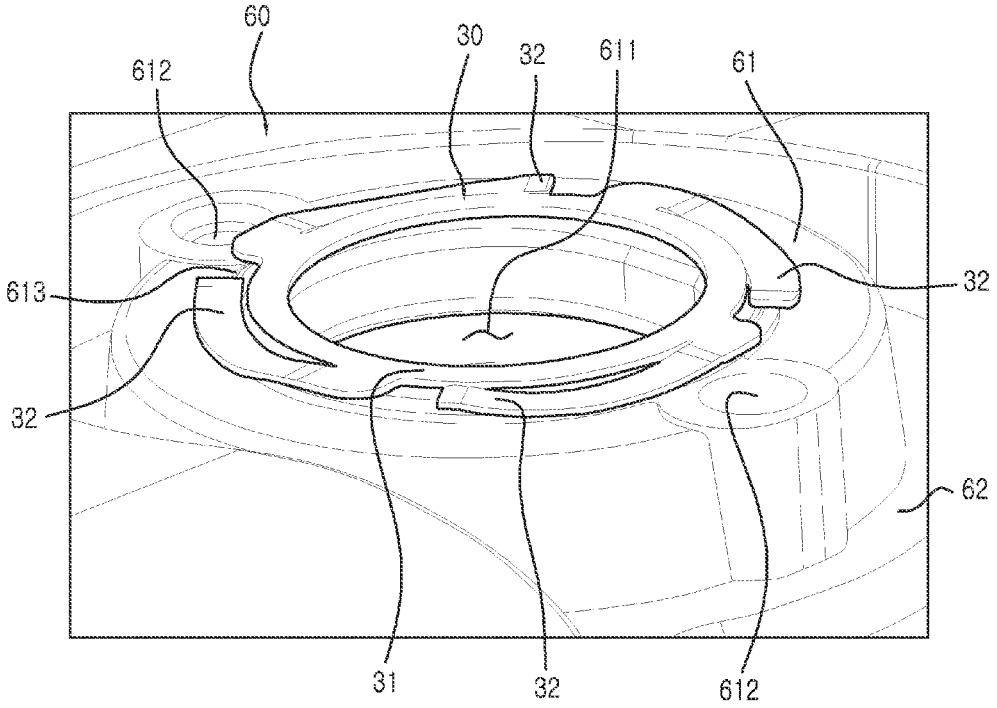
FIG. 9 illustrates a combined state of a housing and a plate spring according to various embodiments of the present disclosure.

FIG. 9 illustrates a combined state of a housing and a plate spring according to various embodiments of the present disclosure.

Referring to FIG. 9, the housing 60 may include the cylindrical portion 61 and the groove 62. The cylindrical portion 61 may include the hollow 611, which passes through between an upper portion and a lower portion, in a center portion. The groove 62 may be formed on a circumferential portion of the cylindrical portion 61. The groove 62 may have a shape which is open in an upward direction, and may have a shape in which one portion is open in a frontward direction (e.g., a screen direction) of an electronic device. The cylindrical portion 61 may include the pair of ball plunger holes 612 facing each other about the hollow 611. The pair of ball plunger holes 612 may be open in an upward direction. The plate spring 30 may include the circular ring piece 31 and a plurality of elastic pieces 32. The hollow hole 311 may be formed in a center of the circular ring piece 31. The plurality of elastic pieces 32 may be extended obliquely in a circular direction and an upward direction from a lateral portion of the circular ring piece 31. The circular ring piece 31 of the plate spring 30 may be disposed above the circular-shape ring protrusion 613 formed on the cylindrical portion 61 of the housing 60. Optionally, the plate spring 30 may be excluded from the key apparatus 1 of the present disclosure.

Figure 10:
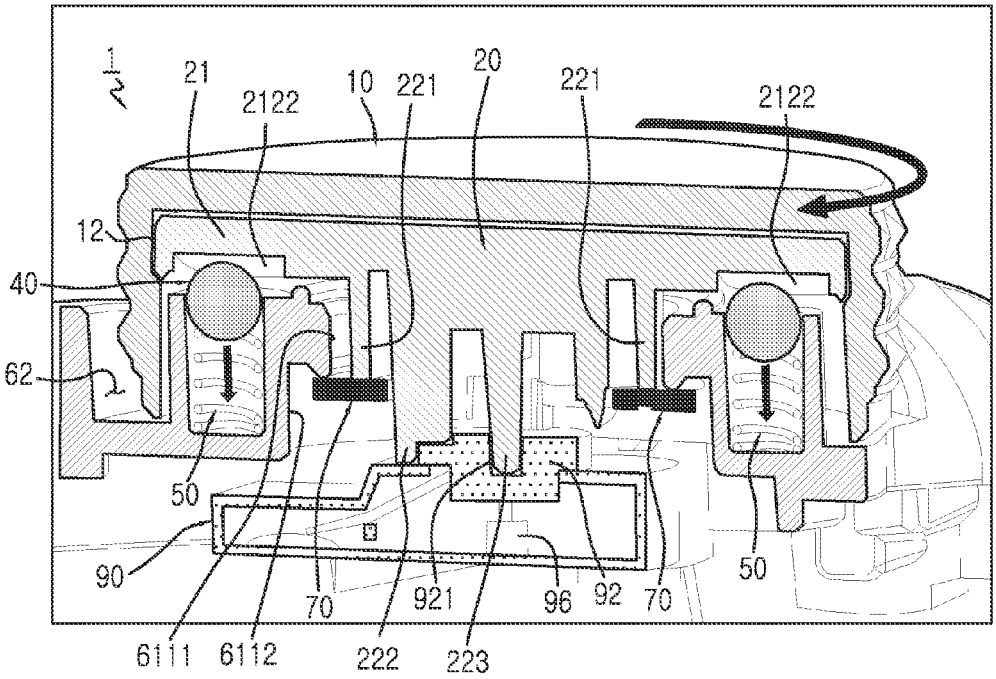
FIG. 10 and FIG. 11 are partial cross-sectional views of a key apparatus according to various embodiments of the present disclosure.
Figure 11:
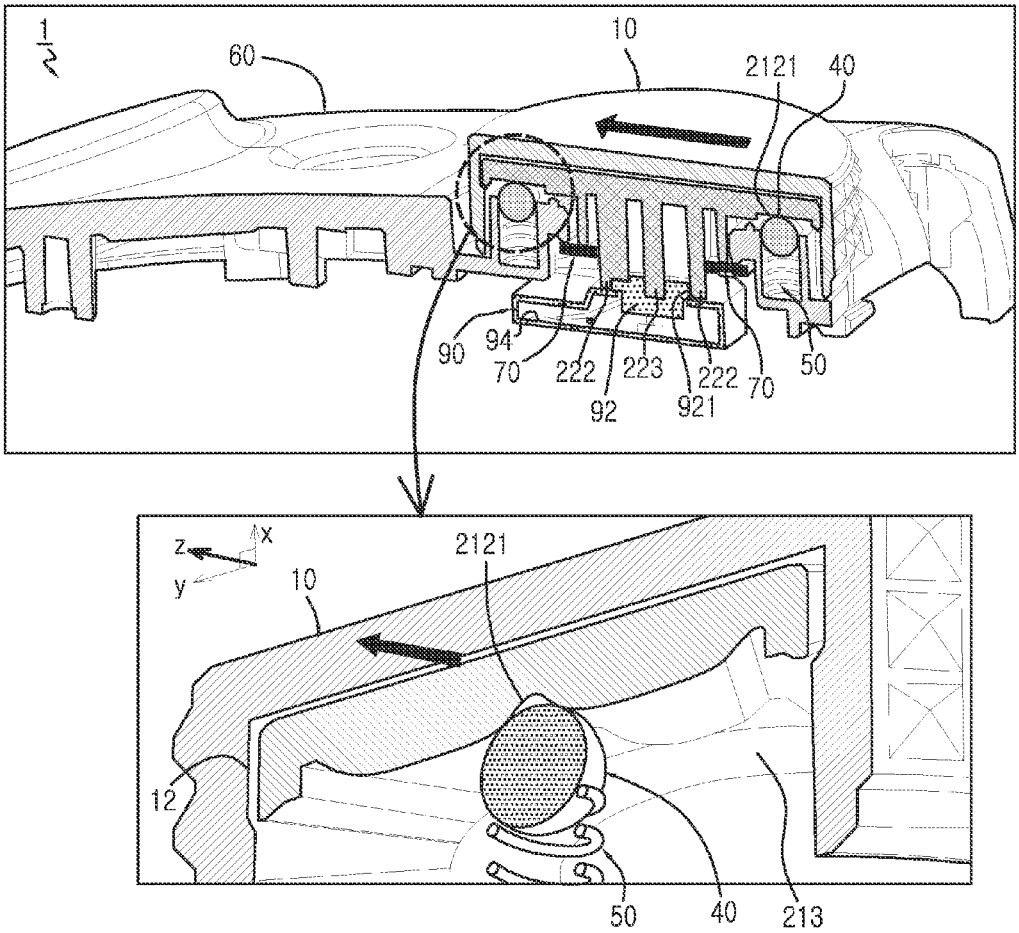

FIG. 10 and FIG. 11 are partial cross-sectional views of a key apparatus according to various embodiments of the present disclosure.

Referring to FIGS. 10 and 11, the key apparatus 1, the circular-plate portion 21 of the knob 20 may be inserted to fit the groove 12 formed to an inner side of the cap 10. The cap 10 which fixes the knob 20 may be connected to the cylindrical portion 61 and the groove 62 of the housing 60. The cylindrical portion 221 extended from the circular-plate portion 21 of the knob 20 may pass through the upper opening 6111 of the housing 60. The fixing plate 70 may be disposed to the lower opening 6112, and may be in contact with the cylindrical portion 221 of the knob 20. The pair of bolts (see 80 of FIG. 1) may pass through the pair of bolt through-holes 72 of the fixing plate 70 and then may be bolt-jointed with the pair of bolt fixing holes (see 224 of FIG. 3) formed around the cylindrical portion 221 of the knob 20. Since the circular-plate portion 21 of the knob 20 has a wider width than the upper opening 6111 of the housing 60, the knob 20 may move in a downward direction. Since the fixing plate 70 has a wider width than the upper opening 6111 of the housing 60, the knob 20 cannot be deviated in an upward direction. The center shaft 223 and the plurality of satellite shafts 222 may be disposed inside the cylindrical portion 221, and may pass through the shaft through-hole 71 of the fixing plate 70. The center shaft 223 and the plurality of satellite shafts 222 may be inserted to the groove 921 provided in the mover 91 of the switch unit 90.

Referring to FIG. 10, if the cap 10 rotates, the pair of balls 40 may move upward and downward by a cam movement. For example, if the cap 10 rotates, the pair of balls 40 are deviated from the concave portion 2121 of the knob 20 and is in contact with a convex portion 2122, and may move downward by being elastically supported by the pair of compression springs 50. At a moment where the pair of balls 40 are deviated from the convex portion 2122, the cap 10 rotates due to elastic pressing of the pair of balls 40, and the pair of balls 40 may be located to the concave 2121, thereby securing stability. If the cap 10 rotates, the plurality of satellite shafts 222 of the knob 20 may allow the mover 92 of the switch unit 90 to rotate about the center shaft 223, and the rotary switch 96 of the switch unit 90 may be switched over.

Referring to FIG. 11, the pair of balls 40 may be disposed to the pair of concave portions 2121 facing each other. The pair of concave portions 2121 of the knob 20 may be in contact with the pair of balls 40 in a sliding manner, and the knob 20 may move linearly. If the cap 10 moves linearly (e.g., moves linearly in a Z-axis direction), the center shaft 223 and the plurality of satellite shafts 222 of the knob 20 may allow the mover 92 to move linearly, and the dome switch 94 of the switch unit 90 may be pressed.

Figure 12:
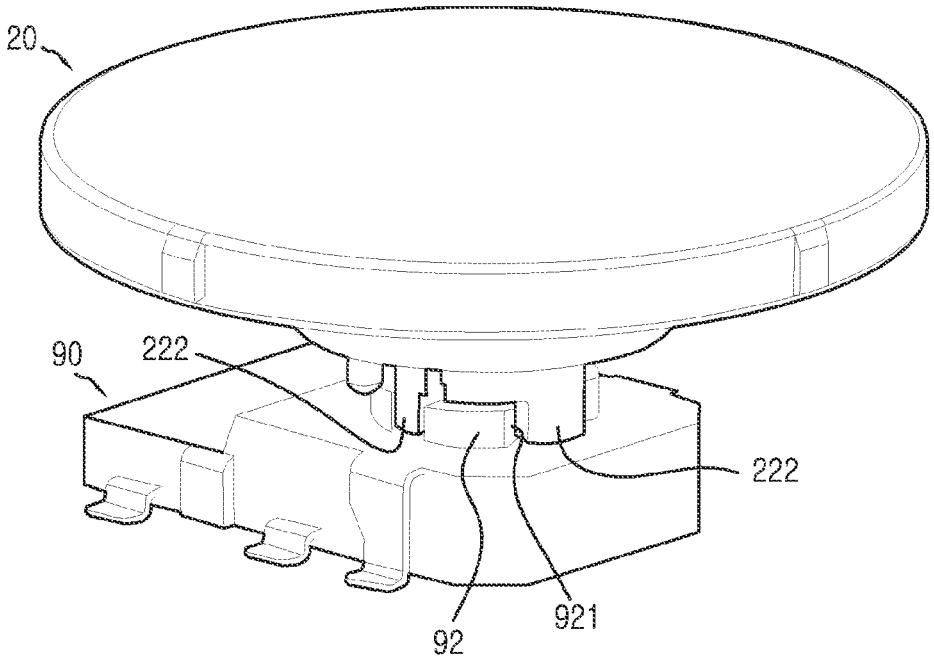
FIG. 12 illustrates a combination of a knob and a switch unit according to various embodiments of the present disclosure.

FIG. 12 illustrates a combination of a knob and a switch unit according to various embodiments of the present disclosure.

Referring to FIG. 12, the plurality of satellite shafts 222 of the knob 20 may be connected to the grooves 921 formed to the mover 92 of the switch unit 90, and may allow the mover 92 to rotate or linearly move.

Figure 13:
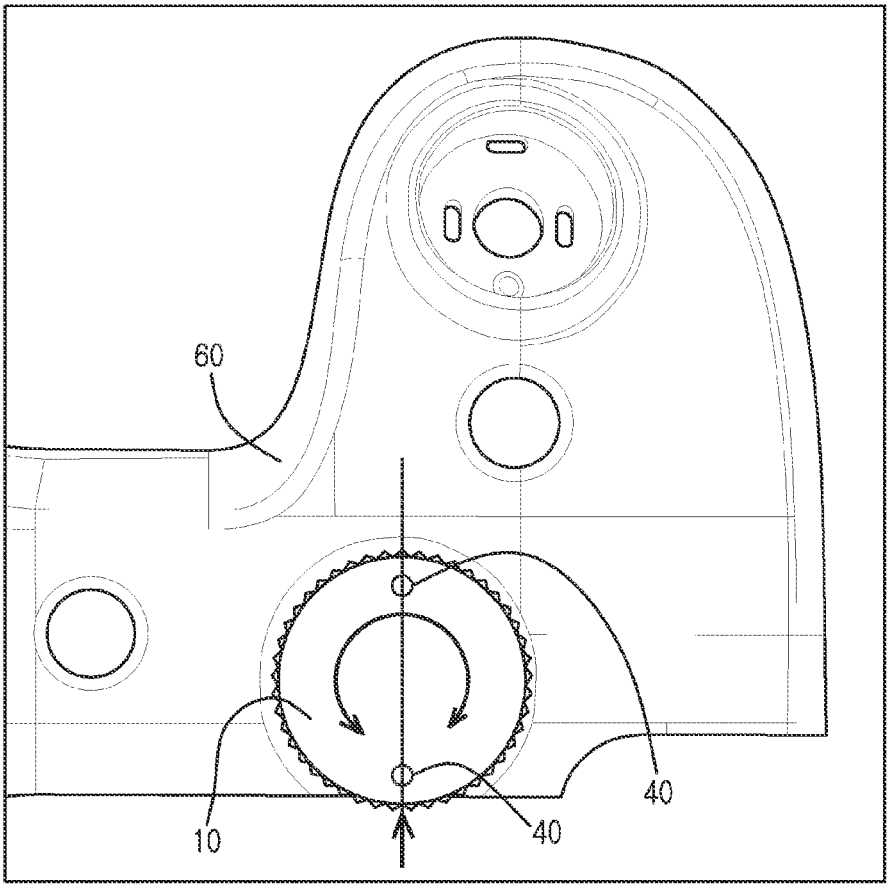
FIG. 13 illustrates a movement of a cap according to various embodiments of the present disclosure.

FIG. 13 illustrates a movement of a cap according to various embodiments of the present disclosure.

Referring to FIG. 13, the cap 10 may rotate. The cap 10 may move linearly in a facing direction (e.g., a direction vertical to a screen) of the pair of balls 40.

According to various embodiments of the present disclosure, the key apparatus 1 of the electronic device may include the housing 60 including the cylindrical portion 61 of which upper and lower portions are open, the circular-plate portion 21 including the concavo-convex portion 212 in which the concave portion 2121 and the convex portion 2122 are alternately arranged in a circular manner, the extension portion 22 extended downward from the circular-plate portion 21 and inserted to the hollow 611 of the circular-plate 61, the knob 20 movable on the cylindrical portion 61, the anti-deviation means (e.g., the fixing plate 70) for preventing the knob 20 from deviating from the cylindrical portion 61, the elastic means (e.g., the compression spring 50) for elastically pressing the concavo-convex portion 212 below the circular-plate portion 21, and the switch (e.g., the switch unit 90) switched over when at least one movement of the extension portion 22 is delivered.

According to various embodiments of the present disclosure, the anti-deviation means may include the fixing plate 70 disposed to the hollow 611 of the cylindrical portion 61 and connected to the extension portion 22.

According to various embodiments of the present disclosure, the extension portion 22 may include the first extension portion (e.g., the cylindrical portion 221) bolt-jointed with the fixing plate 70 and the second extension portion (e.g., the plurality of shafts 222 and 223) passing through the fixing plate 70 and connected to the switch (e.g., the switch unit 90).

According to various embodiments of the present disclosure, the first extension portion (e.g., the cylindrical portion 221) may have a cylindrical shape, and the second extension portion (e.g., the plurality of shafts 222 and 223) may be disposed to an inner side of the first extension portion (e.g., the cylindrical portion 221).

According to various embodiments of the present disclosure, the second extension portion (e.g., the plurality of shafts 222 and 223) may include the center shaft 222 and the plurality of satellite shafts 223 disposed around the center shaft 222.

According to various embodiments of the present disclosure, the hollow 611 of the cylindrical portion 61 may include the upper hollow 6111 and the lower hollow 6112 disposed below the upper hollow 6111, connected to the upper hollow 6111, and having a wider width than the upper hollow 6111. The fixing plate 70 may be disposed to the lower hollow 6112, and may be prevented from moving in an upward direction due to the upper hollow 6111.

According to various embodiments of the present disclosure, the elastic means may include the pair of ball plunger holes 612 disposed around the cylindrical portion 61 to face each other about the cylindrical portion 61 and open in an upper portion, the pair of compression springs 50 contained in the pair of ball plunger holes 612, and the pair of balls 40 elastically supported from the pair of compression springs 50 and elastically pressing the concavo-convex portion 212 of the circular-plate portion 21.

According to various embodiments of the present disclosure, the knob 20 may linearly move in a facing direction of the pair of ball plunger holes 612.

According to various embodiments of the present disclosure, if the knob 20 linearly moves, the pair of balls 40 may be in contact with the concave portion 2121 of the circular-plate portion 21 in a sliding manner.

According to various embodiments of the present disclosure, the hollow 611 of the cylindrical portion 61 has a relatively long shape in a linear movement direction of the knob 20.

According to various embodiments of the present disclosure, the knob 20 may linearly move in a horizontal direction.

According to various embodiments of the present disclosure, the knob 20 may rotate about the extension portion 22.

According to various embodiments of the present disclosure, the circular-plate portion 21 may be formed on a circumference of the extension portion 22, and may have a ring-shaped flat circular contact surface 213 disposed between the concavo-convex portions 212. The circular-plate portion may include a ring-shaped elastic spring (e.g., the plate spring 30) disposed between the cylindrical portion 61 of the housing 60 and the circular contact surface 213.

According to various embodiments of the present disclosure, the cylindrical portion 61 may have a shape which is tapered upward.

According to various embodiments of the present disclosure, the concave portion 2121 or the convex portion 2122 may be arranged in an even-number pair.

According to various embodiments of the present disclosure, a connection portion of the concave portion 2121 and the convex portion 2122 may be connected smoothly.

According to various embodiments of the present disclosure, the key apparatus 1 may include the cap 10 having a shape of a circular container including the containing portion 111 which is open in a downward direction. The circular-plate portion 21 of the knob 20 may be inserted to fit the containing portion 111 and the cap 10 may cover the cylindrical portion 61 of the housing 60.

According to various embodiments of the present disclosure, the switch (e.g., the switch unit 90) may be mounted on the Printed Circuit Board (PCB) 100 fixed to an inner side of the housing 60.

According to various embodiments of the present disclosure, the switch (e.g., the switch unit 90) may include the mover 91 connected to the extension portion 22, the first switch (e.g., the rotary switch 96) switched over when a rotation movement is delivered from the mover 91, and the second switch (e.g., the dome switch 94) switched over when a linear movement is delivered from the mover 91.

A key apparatus capable of replacing a plurality of key buttons may decrease a cost and improve usability. The key apparatus may improve a manipulation sense of a switch (e.g., a rotary switch) which is switched over according to various motions (e.g., a rotation or linear movement).

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A key apparatus in an electronic device, the key apparatus comprising:

a housing having a cylindrical portion, the cylindrical portion including an upper portion and a lower portion, the upper portion and the lower portion being open;

a knob including a circular-plate portion, the circular plate portion having a concavo-convex portion, the concavo-convex portion including a concave portion and a convex portion arranged alternately in a circular shape and an extension portion extended from the circular-plate portion in a downward direction and inserted into a hollow of the cylindrical portion, and the knob moves on the circular-plate portion;

an anti-deviation unit configured to prevent the knob from being deviated from the cylindrical portion;

an elastic unit configured to elastically press the concavo-convex portion at a lower side of the circular-plate portion; and a switch comprising a mover connected to the extension portion, wherein the switch is configured to switch over when one or more of a rotation movement or a linear movement from the mover is delivered.

2. The key apparatus of claim 1, wherein the anti-deviation unit comprises a fixing plate disposed in the hollow of the cylindrical portion and connected to the extension portion.

3. The key apparatus of claim 2, wherein the extension portion comprises:

a first extension portion bolt-jointed with the fixing plate; and a second extension portion passing through the fixing plate and connected with the switch.

4. The key apparatus of claim 3, wherein the first extension portion has a cylindrical shape, and the second extension portion is disposed in an inner side of the first extension portion.

5. The key apparatus of claim 3, wherein the second extension portion comprises:

a center shaft; and a plurality of satellite shafts disposed around the center shaft.

6. The key apparatus of claim 2, wherein the hollow of the cylindrical portion comprises an upper hollow, and a lower hollow disposed below the upper hollow, connected to the upper hollow, and having a wider width than the upper hollow, and wherein the fixing plate is disposed to the lower hollow and is prevented from moving in an upward direction due to the upper hollow.

7. The key apparatus of claim 1, wherein the elastic unit comprises:

a pair of ball plunger holes being disposed around the cylindrical portion to face each other about the cylindrical portion, and an upper portion being open;

a pair of compression springs contained in the pair of ball plunger holes; and a pair of balls elastically supported from the pair of compression springs and elastically pressing a concavo-convex portion of the circular-plate portion.

8. The key apparatus of claim 7, wherein the knob linearly moves in a facing direction of the pair of ball plunger holes.

9. The key apparatus of claim 8, wherein if the knob linearly moves, the pair of balls is in contact with a concave portion of the circular-plate portion in a sliding manner.

10. The key apparatus of claim 8, wherein the hollow of the cylindrical portion has a relatively long shape in a linear movement direction of the knob.

11. The key apparatus of claim 1, wherein the knob linearly moves in a horizontal direction.

12. The key apparatus of claim 1, wherein the knob rotates about the extension portion.

13. The key apparatus of claim 1, wherein the circular-plate portion is formed on a circumference of the extension portion, and has a ring-shaped flat circular contact surface disposed between the concavo-convex portions, further comprising a ring-shaped elastic spring disposed between the cylindrical portion of the housing and the circular contact surface.

14. The key apparatus of claim 1, wherein the cylindrical portion is tapered upward.

15. The key apparatus of claim 1, wherein the concave portion and the convex portion are arranged in an even-number pair.

16. The key apparatus of claim 1, wherein the concavo-convex portion is formed in a specific length in a direction of the center of the circular-plate portion.

17. The key apparatus of claim 1, further comprising a cap having a shape of a circular container including a containing portion open in a downward direction, wherein a circular-plate portion of the knob is inserted to fit the containing portion and the cap covers a cylindrical portion of a housing.

18. The key apparatus of claim 1, wherein the switch is mounted on a Printed Circuit Board (PCB) fixed to an inner side of the housing.

19. The key apparatus of claim 1, wherein the switch comprises:

a first switch switched over when the rotation movement from the mover is delivered; and a second switch switched over when the linear movement from the mover is delivered.

20. A key apparatus of an electronic appliance, the key apparatus comprising:

a housing having a cylindrical portion, the cylindrical portion including an upper portion and a lower portion, the upper portion and the lower portion being open, and a pair of ball plunger holes, upper portions of the pair of ball plunger holes being open and being disposed to face each other around the cylindrical portion;

a knob including a circular-plate portion, the circular-plate portion having a concavo-convex portion including a concave portion and a convex portion alternately arranged in a circular shape and an extension portion extended from the circular-plate portion in a downward direction and inserted to a hollow of the cylindrical portion, the extension portion having a first extension portion including a pair of bolt fixing holes facing each other and a second extension portion disposed inside the first extension portion and including a center shaft and a plurality of satellite shafts arranged around the center shaft; and a pair of compression springs contained in the pair of ball plunger holes;

a pair of balls elastically supported from the pair of compression springs and elastically pressing the concavo-convex portion of the circular-plate portion;

a fixing plate disposed in a hollow of the cylindrical portion, the fixing plate having a pair of bolt fixing holes bolt-jointed with the pair of bolt fixing holes of the first extension portion, and having a shaft through-hole through which the second extension portion passes; and a switch placed on a Printer Circuit Board (PCB), the switch connected to the second extension portion, and switched over when one of a rotation movement and a linear movement of the second extension portion is delivered, wherein the knob rotates about the extension portion, and in case of passing one of the concave portion and the convex portion, the pair of balls moves one of upward and downward on the pair of ball plunger holes, and wherein the knob selectively moves linearly in a facing direction of the pair of ball plunger holes, and the pair of balls are in contact with a linear groove formed on the concave portion in a sliding manner.

* * * * *